US006511390B2

(12) United States Patent
Kim

(10) Patent No.: US 6,511,390 B2
(45) **Date of Patent: *Jan. 28, 2003**

(54) SPORTS BALL NET ASSEMBLY

(76) Inventor: Bae-Kyun Kim, Samick Villa Apt 5-1201, #148, Namchun-Dong, Suyung-Ku, Pusan (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/883,601

(22) Filed: Jun. 19, 2001

(65) Prior Publication Data

US 2002/0193186 A1 Dec. 19, 2002

(51) Int. Cl.[7] ..... A63B 69/00

(52) U.S. Cl. ..... 473/446; 473/478; 473/439; 273/407

(58) Field of Search ..... 473/438, 433, 473/439, 477, 478, 485, 197, 446; 273/407, 408

(56) References Cited

U.S. PATENT DOCUMENTS 2,895,737 A * 7/1959 Blees ..... 473/478
3,820,787 A * 6/1974 Heinbigner ..... 473/439
5,269,527 A * 12/1993 Noval ..... 473/197
6,210,288 B1 4/2001 Kim

* cited by examiner

*Primary Examiner*—Paul T. Sewell
*Assistant Examiner*—Nini F. Legesse
(74) *Attorney, Agent, or Firm*—Harrison & Egbert

(57) ABSTRACT

A net assembly which allows a user to easily and conveniently practice the launching, throwing or kicking of sports balls (such as baseballs, soccer balls and footballs) in a limited and/or indoor area, and is easily carried, kept or installed. In the net assembly, the net is appropriately tensioned, thus effectively stopping flying balls without failure. The net assembly has a U-shaped base pipe unit laid on a support surface. A main support pipe is mounted to an end of each side arm of the base pipe unit. The support pipe extends upwardly and is inclined outwardly relative to the side arm at an angle of 45°±10°. First and second tension pipes are coupled to each other using a joint, thus forming a tension pipe unit with a holding pin being provided at an outside end of the tension pipe unit for holding a net. The tension pipe unit is mounted to the support pipe at the lower end thereof.

1 Claim, 6 Drawing Sheets

SPORTS BALL NET ASSEMBLY

BACKGROUND OF THE INVENTION

1. Field of the Invention

The present invention relates, in general, to a golf practice net assembly and, more particularly, to a net assembly capable of allowing a user to easily and conveniently practice the launching retrieval of various sports balls in a limited area with a net of the assembly being appropriately tensioned so as to effectively stop and retain the launched sports balls.

2. Description of the Prior Art

Various sports use different types of balls as an element within the particular game. These balls can include baseballs, soccer balls and footballs. Unfortunately, in many circumstances, it is necessary to have two persons involved in the throwing and return of the sports ball. For example, one can practice the throwing of baseballs, but the effort required to gather the ball after the throw would discourage such activity. Similarly, if soccer balls are kicked for a very long distance, the person kicking the ball must retrieve the ball a very long distance from where it is launched. In certain circumstances, targets have been used whereby the ball can be directed toward the target. Unfortunately, these targets can often misdirect the ball or cause the ball to travel a greater distance than if the target had not existed.

Where practice with the particular sports ball is required, then it would be desirable to have a net assembly available whereby the ball can be captured so that the person throwing or kicking the ball can easily retrieve the ball a short distance from where the ball is launched.

FIG. 1 is a view, showing prior art practice net assembly capable of allowing a user to practice golf-shots in a limited area. As shown in the drawing, the typical net assembly 1 comprises a net 4 held by a support pipe frame. The above pipe frame is formed by a plurality of flexible support pipes 2. In order to pitch the net assembly 1, the support pipes 2 are primarily coupled to each other into a pipe frame prior to being set on a support surface. In such a case, the pipe frame is bent into an arc-shaped configuration with both ends of the frame being held on the support surface. After securing the pipe frame to the support surface, the net 4 is held on the frame using a plurality of tieing bands 6, thus being pitched on the support surface.

However, the above net assembly 1 is problematic in that the pipe frame is only set on a support surface by both ends thereof without having any separate support means, thus failing to firmly support the net assembly 1. The net assembly 1 may thus easily fall over backward when it stops a flying ball. The net assembly 1 forms a two-dimensional stopping surface with a limited area, thus sometimes failing to stop a golf ball when the driving direction of the ball diverges from the stopping area of the assembly 1. In such a case, the ball may strike a person around the net assembly 1, thus-causing safety hazards. Another problem of the above net assembly 1 resides in that the net 4 is not desirably tensioned, but is somewhat loosened, thus failing to appropriately stop flying balls.

The present inventor is the owner of U.S. Pat. No. 6,210,288, issued on Apr. 3, 2001, and entitled "Golf Practice Net Assembly". Subsequent to the issuance of this patent, it was discovered that it would be desirable to provide such a device for use in association with other sports balls, such as baseballs, soccer balls and footballs. U.S. Pat. No. 6,210,288 teaches a Golf Practice Net Assembly which allows the user to easily and conveniently practice tee-shots in a limited and/or indoor area. In the net assembly, the net is appropriately tensioned so as to effectively stop flying balls without failure. The net assembly has a U-shaped unit laid on a support surface. A main support pipe is mounted to an end of each side arm of the base pipe unit. The support unit extends upwardly and is inclined outwardly relative to the side arm at an angle of 45°±10°. The first and second tension pipes are coupled to each other using a joint, thus forming a tension pipe unit with a holding pin being provided at an outside of the tension pipe unit for holding a net. The tension pipe unit is mounted to the support pipe at a lower end thereof.

SUMMARY OF THE INVENTION

Accordingly, the present invention has been made keeping in mind the above problems occurring in the prior art, and an object of the present invention is to provide a practice net assembly, which allows a user to easily and conveniently practice the launching (by throwing or kicking) of various sports balls in a limited and/or indoor area, which is easily carried, kept or installed, and of which the net is appropriately tensioned, thus effectively stopping flying balls without failure.

In an effort to accomplish the above object, the present invention provides a net assembly, comprising: a U-shaped base pipe unit laid on a support surface; a main support pipe mounted to an end of each side arm of the base pipe unit, the support pipe extending upwardly and being inclined outwardly relative to the side arm at an angle of 45°±10°; and first and second tension pipes coupled to each other using a joint, thus forming a tension pipe unit with a holding pin being provided at an outside end of the tension pipe unit for holding a net, the tension pipe unit being mounted to the support pipe at a lower end thereof.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
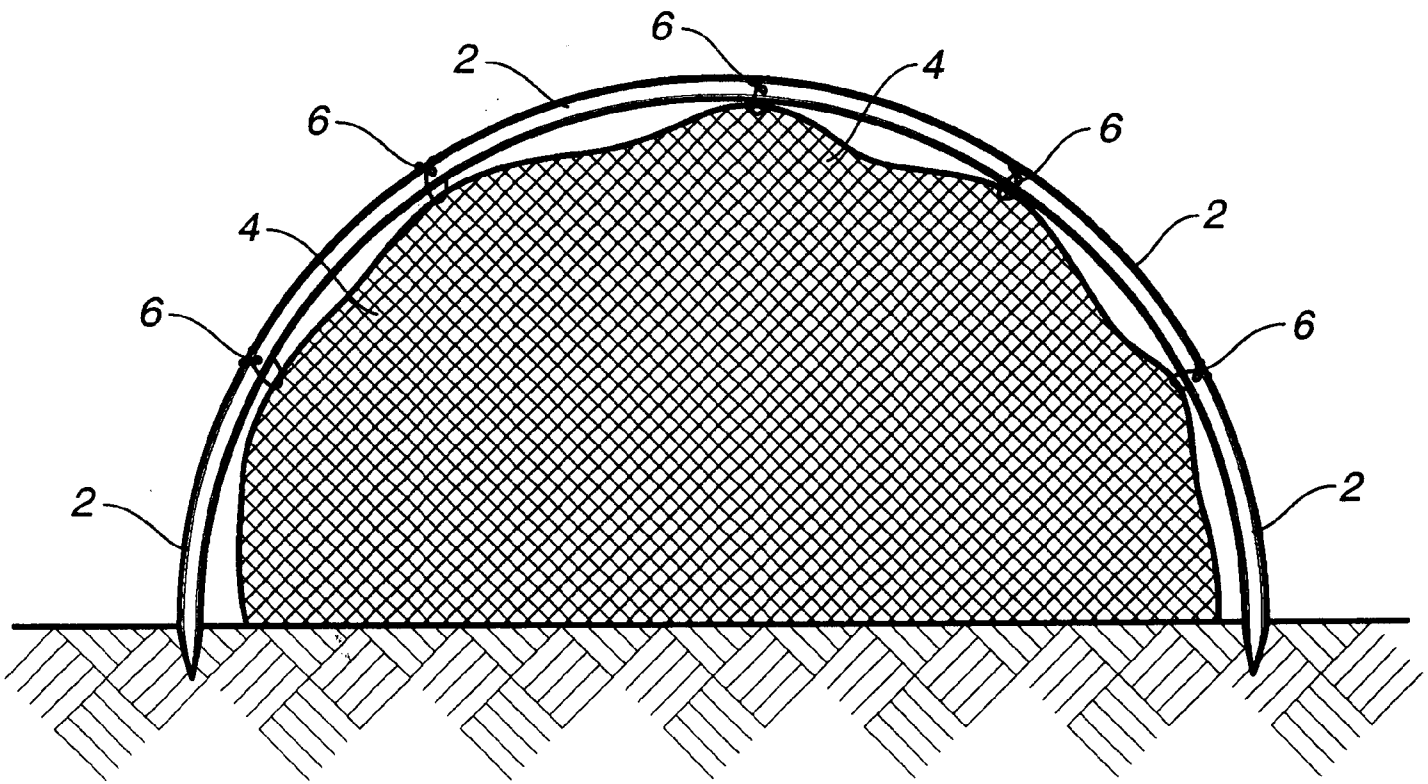
FIG. 1 Prior Art
FIG. 1 is a view, showing a typical practice net assembly.
Figure 2:
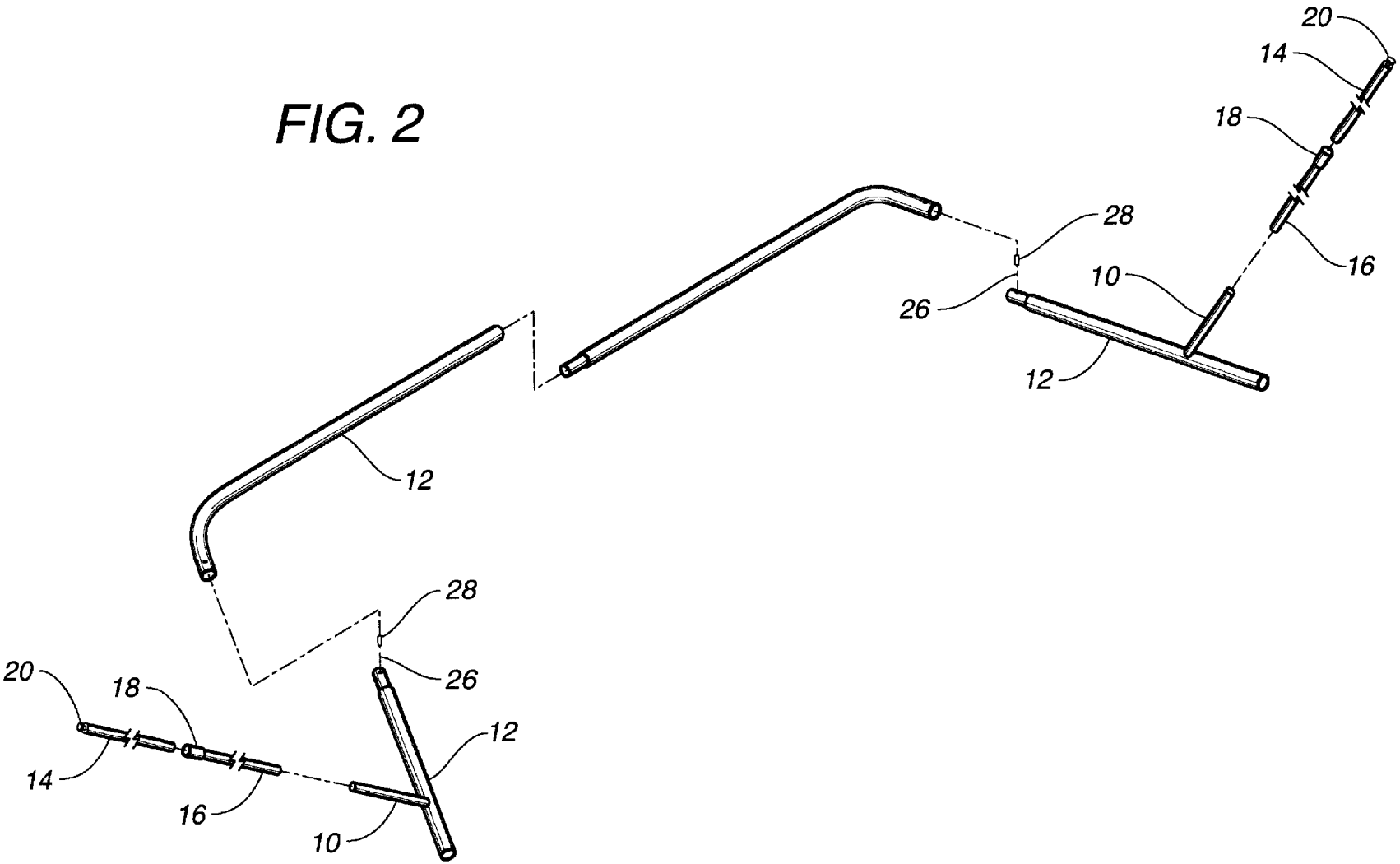
FIG. 2 is an exploded perspective view of a support pipe frame of a sports ball practice net assembly in accordance with the primary embodiment of the present invention.
Figure 3:
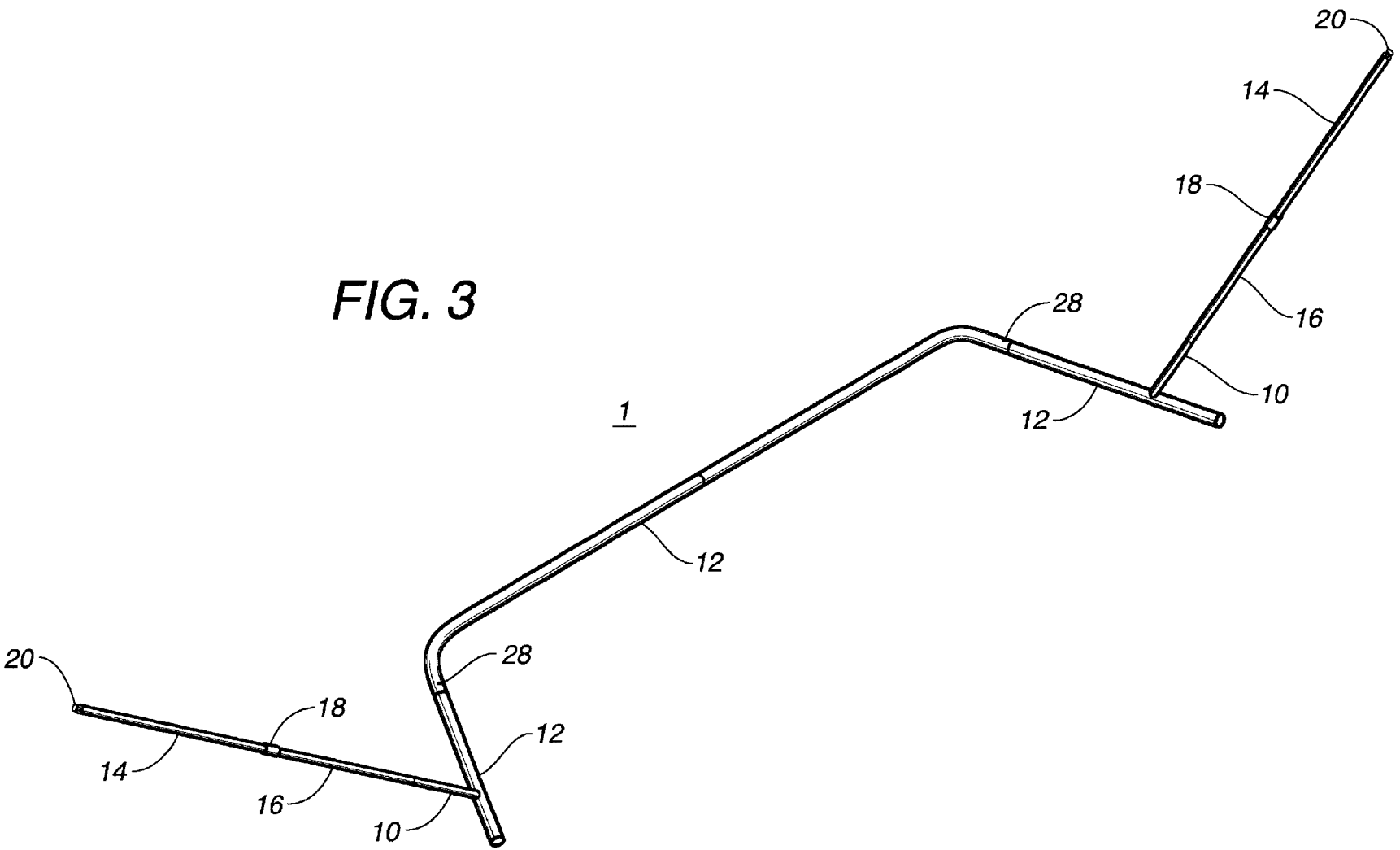
FIG. 3 is a perspective view of the support pipe frame of FIG. 2, with the pipes of the frame being assembled into a single body.

FIG. 2 is an exploded perspective view of a support pipe frame of a sports ball net assembly in accordance with the primary embodiment of this invention. FIG. 3 is a perspective view of the support pipe frame of FIG. 2, with the pipes of the frame being assembled into a single body. As shown in the drawings, the support pipe frame of the net assembly 1 comprises a U-shaped base pipe unit 12 which is to be laid on a support surface. Two fixed support pipes 10 being respectively fixed to the ends of both side arms of the base pipe unit 12 while extending upwardly and being inclined outwardly relative to the side arms at an angle of 0°. First and second tension pipes 14 and 16 are coupled to each other using a joint 18, thus forming a tension pipe unit. The tension pipe unit is mounted to each fixed support pipe 10 at the lower end of the second tension pipe 16. A holding pin 20 is provided at the outside end of each of the first tension pipes 14. Of course, a hollow or solid pipe may be preferably used as each of the first and second tension pipes 14 and 16.

In the present invention, the angle, 0°, is 45°±10°.

Figure 4A:
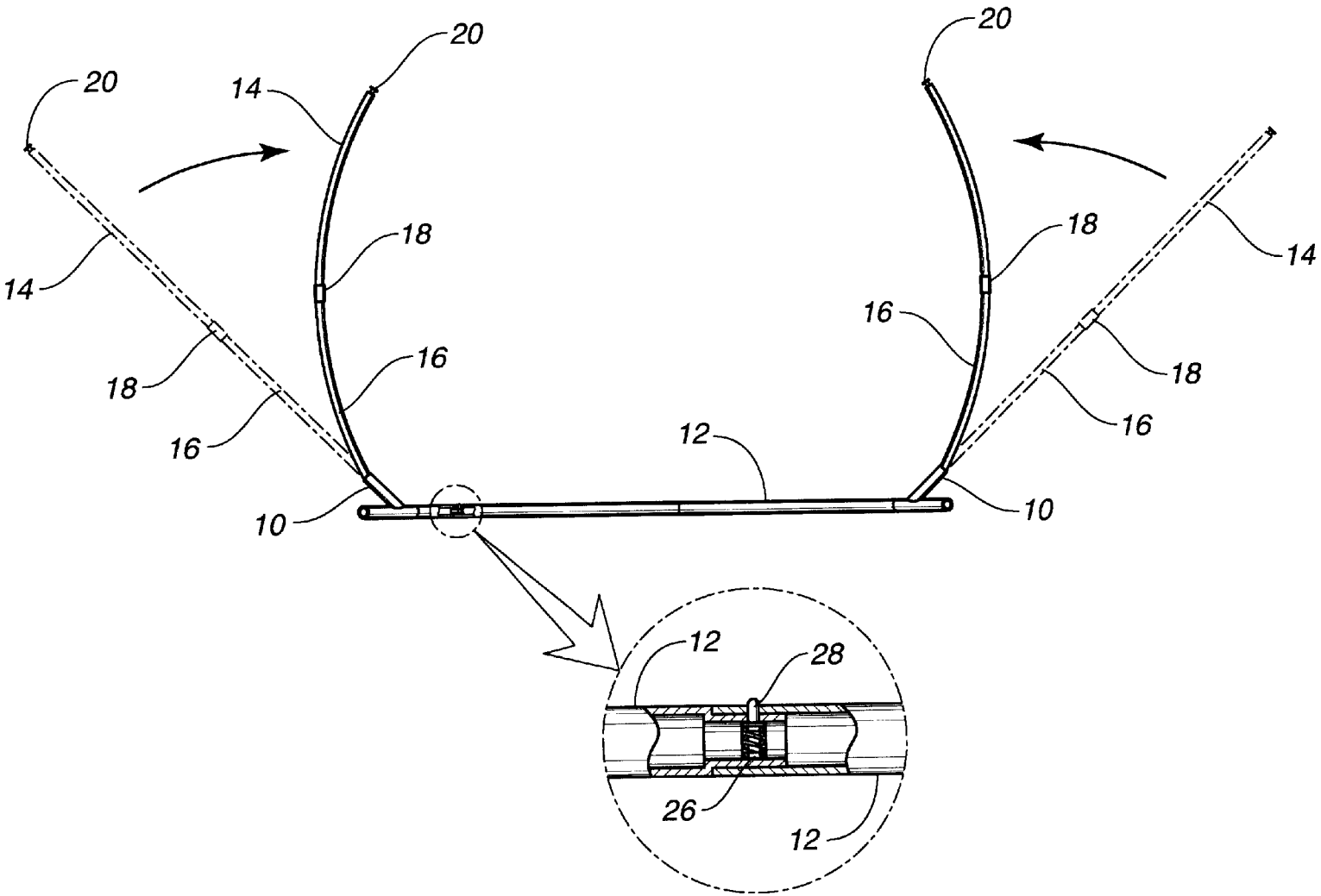
FIG. 4*a* is a view, showing the support pipe frame of FIG. 2 when it is installed on a support surface.
Figure 4B:
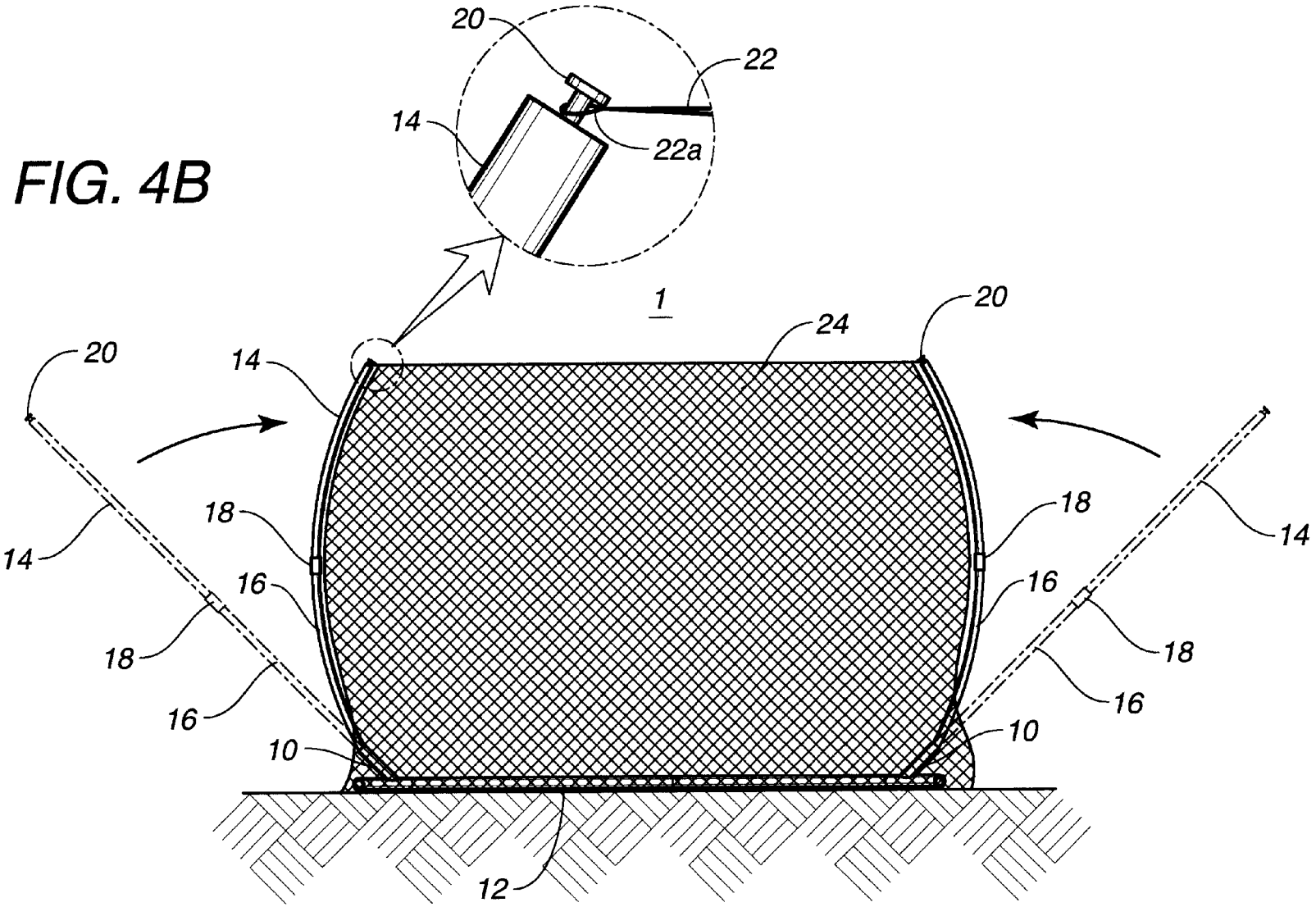
FIG. 4*b* is a view, showing the net assembly with a net being held on the support pipe frame of FIG. 4*a*.

FIG. 4*a* shows the support pipe frame of FIG. 2 when it is installed on a support surface. FIG. 4*b* shows the net assembly with a net being held on the support pipe frame of FIG. 4*a*. As shown in FIG. 4*a*, the first and second tension pipes 14 and 16 are coupled to each other using a joint 18, thus forming a tension pipe unit. The tension pipe unit is mounted to each support pipe 10 at the lower end of the second tension pipe 16 prior to being elastically bent inwardly. Thereafter, the net 22 is held by the support pipe frame with both top comers of the net 22 being caught by the holding pins 20.

In the above support pipe frame, the base pipe unit 12 comprises a plurality of pipes which are coupled to each other using spring-biased, retractable projections 28 provided at the joints of the pipe unit 12.

Figure 5:
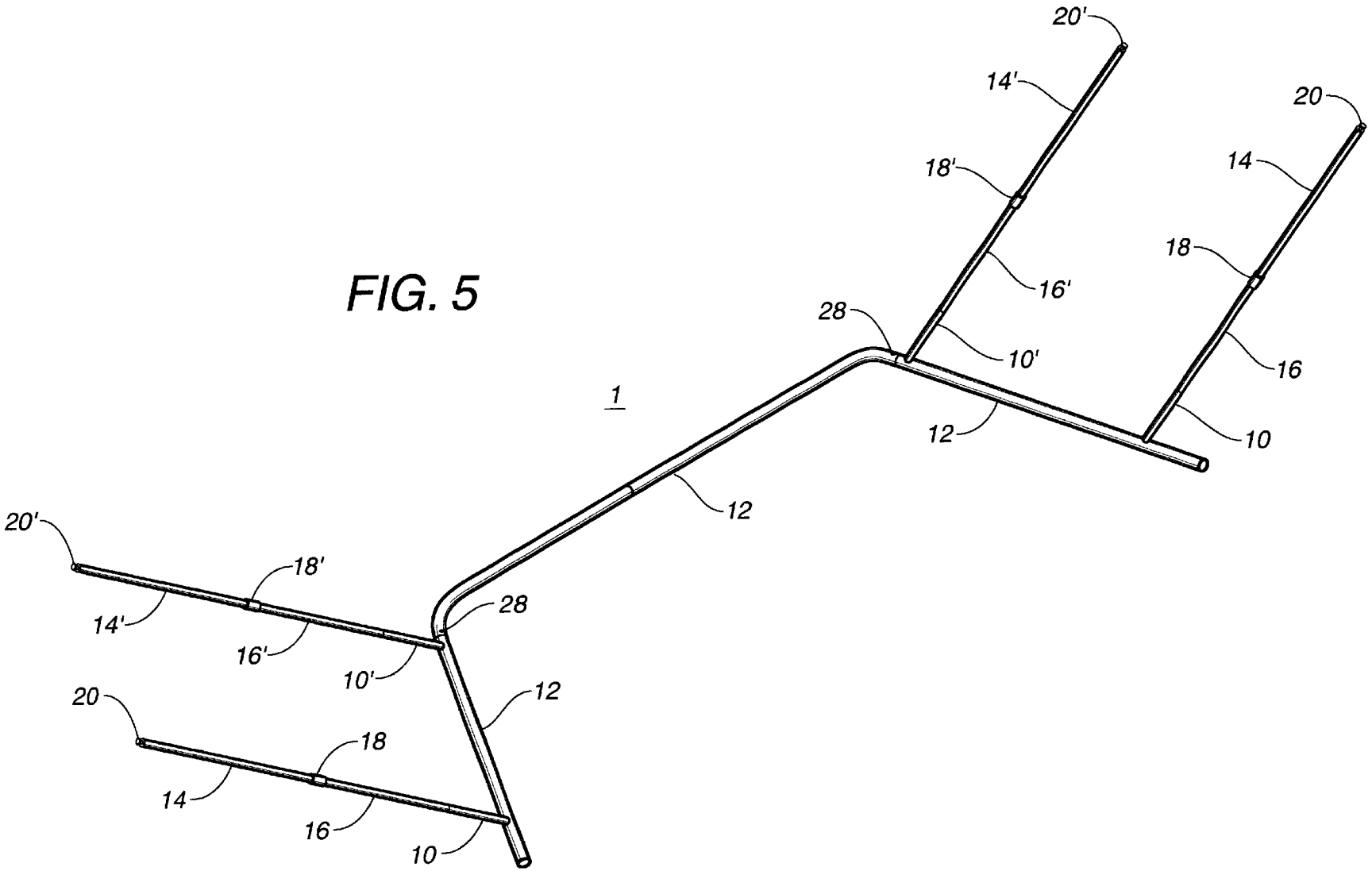
FIG. 5 is a perspective view of a support pipe frame of a sports ball net assembly in accordance with the second embodiment of this invention.

FIG. 5 is a perspective view of a support pipe frame of a sports ball practice net assembly in accordance with the second embodiment of this invention. In the second embodiment, the general shape of the support pipe frame remains the same as that described for the primary embodiment, but an auxiliary support pipe 10' is fixedly mounted to each side arm of the base pipe unit 12 at a position around each comer of the U-shaped pipe unit 12. That is, the support pipe frame according to the second embodiment has two support pipes 10 and 10' at each side arm of the base pipe unit 12. First and second tension pipes 14 and 16 are coupled to each other using a joint 18, thus forming a primary tension pipe unit. The tension pipe unit is mounted to each primary support pipe 10 at the lower end of the second tension pipe 16, while third and fourth tension pipes 14' and 16' are coupled to each other using a joint 18, thus forming a second tension pipe unit. The second tension pipe unit is mounted to each auxiliary support pipe 1,0' at the lower end of the fourth tension pipe 16'. Provided at the outside end of each of the first and third tension pipes 14 and 14' is a holding pin 20. A net 22 is held by the support pipe frame while being caught by the holding pins 20, thus forming a three-dimensional net assembly with the front being opened.

The net 22, as used in the present invention, utilizes a relatively thick and hard thread so as to properly stop the relatively heavy baseballs, soccer balls and footballs. The net should be relatively loose so as to effectively retain the sports ball therein.

In the drawings, the reference numeral 22*a* denotes a holding loop provided on the net 22 for holding the net on a pin 20. The numeral 30 denotes a tieing band used for holding the net 20 to the tension pipes of the support pipe frame.

The operational effect of the sports ball practice net assembly of this invention will be described hereinbelow.

The net assembly according to the primary embodiment of this invention is installed as follows. As shown in FIGS. 2 to 4*b*, the pipes of the base pipe unit 12 are primarily coupled to each other into a U-shaped body. Thereafter, the two support pipes 10 are respectively fixed to both side arms of the base pipe unit 12 while allowing the support pipes 10 to be inclined relative to the side arms at an angle of e. The first and second tension pipes 14 and 16 are coupled to each other using a joint 18. The outside end of each first tension pipe 14 has one holding pin 20.

After coupling the tension pipes 14 and 16 to each other, the pipes 14 and 16 are mounted to a fixed support pipe 10 by fitting the lower end of the second tension pipe 16 into the support pipe 10. The pipes 14 and 16 are, thereafter, bent inwardly, thus forming a curved configuration prior to holding both top comers of the net 22 to the holding pins 20 of the two first tension pipes 14. In such a case, the loops 22*a* of the net 22 are caught by the holding pins 20.

The net 22 is also tied to the first and second tension pipes 14 and 16 using the tieing bands 30 at the middle portions of both sides thereof. The net 22 is thus firmly held on the support pipe frame while being appropriately tensioned and pitched by elasticity of the tension pipes 14 and 16.

When installing the net assembly according to the second embodiment of this invention on a support surface, the above-mentioned process is repeated, with third and fourth tension pipes 14' and 16' being coupled to each other using a joint 18 and being mounted to each auxiliary support pipe 10' at the lower end of the fourth tension pipe 16' as shown in FIG. 5. In such a case, the auxiliary support pipes 10' are inclined relative to the side arms of the base pipe unit 12 at an angle of 0°(45°±10°). In the second embodiment, the net 22, held by the support pipe frame while being caught by the holding pins 20, forms a three-dimensional configuration. Such a three-dimensional net 22 almost completely stops flying balls even-when the shots miss their intended target.

In the present invention, it is possible to adjust the height of the net assembly 1 by changing the number of coupled tension pipes held on each support pipe. That is, the tension pipes, held on each support pipe, may be designed to be three or four-staged in place of the two-staged pipes disclosed in the preferred embodiments.

In order to practice the launching of various sports balls by using the net assembly 1, a user throws or kicks a ball at a position spaced apart from the front of the net assembly 1 by a distance. When the sports ball is thrown or kicked toward the net assembly 1, the net 22 stops the ball. In such a case, the net 22 is repeatedly thrust backward due to impact energy of the ball. However, the net 22 is always tensioned by the tension pipes, thus effectively stopping the flying ball.

As described above, the present invention provides a sports ball net assembly, which allows a user to easily and conveniently practice the throwing, launching or kicking of sports balls in a limited area such as an indoor practice facility or roof area. The net assembly has a simple construction, thus being easily installed and reducing production cost and thereby allowing golf to be popularized. In the net assembly, the net is appropriately tensioned so as to effectively stop flying balls without failure.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

I claim:

1. An apparatus comprising:

a sports ball other than a golf ball;

a base pipe unit having a surface suitable for being laid on a support surface, said base pipe unit being entirely U-shaped;

two side arms each coupled by a spring-biased retractable projection to respective opposite ends of said base pipe unit, said two side arms extending outwardly therefrom;

a support pipe fixedly mounted to an end of each of said two side arms of said base pipe unit, said support pipe extending upwardly and being inclined outwardly at an angle of 45°±10° to a vertical axis;

a tension pipe unit mounted at a lower end thereof to said support pipe, said tension pipe unit comprising a first pipe and a second pipe coupled together by a joint, said tension pipe unit having a holding pin at an end opposite said support pipe; and a net means held in a generally curved configuration by said holding pin and said tension pipe unit, said net means for receiving said sports ball when said sports ball is propelled into said net means.

* * * * *